United States Patent [19]

Colten

[11] 4,066,870

[45] Jan. 3, 1978

[54] FLEXIBLE ELECTRIC HEATING CABLE

[75] Inventor: Jerrold L. Colten, Lakeville, Ind.

[73] Assignee: Bristol Products, Inc., Bristol, Ind.

[21] Appl. No.: 747,815

[22] Filed: Dec. 6, 1976

[51] Int. Cl.[2] ..... H05B 3/36

[52] U.S. Cl. ..... 219/528; 200/159 B; 200/302; 200/317; 219/506; 219/535; 219/549; 337/13; 340/252 R

[58] Field of Search ..... 219/211, 212, 506, 527, 219/528, 529, 535, 549; 340/252 R, 252 H, 252 P; 338/214; 337/13; 200/157, 159 B, 302, 313, 314, 315, 316, 317

[56] References Cited

U.S. PATENT DOCUMENTS

| | | | |
|---|---|---|---|
| 2,196,501 | 4/1940 | Kehn | 200/315 |
| 2,752,463 | 6/1956 | Staah | 200/159 B |
| 2,824,209 | 2/1958 | Leopold | 219/528 |
| 3,305,668 | 2/1967 | Smith | 219/528 |
| 3,341,690 | 9/1967 | Commins | 219/528 |
| 3,541,488 | 11/1970 | Odson | 200/159 B X |
| 3,634,655 | 1/1972 | Jordan | 219/527 |
| 3,851,149 | 11/1974 | Daley | 219/528 |

FOREIGN PATENT DOCUMENTS

| | | | |
|---|---|---|---|
| 650,581 | 9/1928 | France | 338/214 |
| 798,387 | 7/1958 | United Kingdom | 200/313 |

*Primary Examiner*—Volodymyr Y. Mayewsky
*Attorney, Agent, or Firm*—Marmaduke A. Hobbs

[57] ABSTRACT

A flexible heating cable having a cold lead section and a heating section, in which a thermostat is disposed in the cold wires of the cold lead section and a light and a switch are disposed in a flexible translucent plastic pouch remotely located from the two sections and are connected to the wires adjacent the thermostat so that the unit can be tested at a position remote from the heating cable installation. The heating section is preferably provided with a socket on the end opposite the cold lead section to permit the coupling therewith of one or more heating section modules, and the switch is preferably operated by depressing the side walls of the remotely located pouch.

10 Claims, 3 Drawing Figures

FLEXIBLE ELECTRIC HEATING CABLE

Flexible heating cables are extensively used for a variety of different purposes, including preventing freezing of water pipes, the accumulation of snow and ice in eaves troughs and along the adjacent edges of roofs, and preventing gutters and downspouts from becoming clogged with ice. These heating cables are made in sections of various lengths, and are adapted either to be connected permanently into the electrical system of the building or merely to be plugged into a standard socket. The flexibility of these sections is important in order to permit the cables to be coiled around the water pipe and to be laid in a circuitous configuration on the roof or along the gutter. While long continuous sections may be used in some installations, it has been found advantageous to use separate sections, possibly of different lengths, coupled together to extend the length of the area to be protected. A connector for coupling such sections is disclosed in U.S. Pat. No. 3,341,690 issued Sept. 12, 1967 and is normally waterproof when the cable is used in the conventional manner. The heating cable consists of two cold wires interconnected at opposite ends by a single hot wire so that each of the sections of modules of the system can operate independently of the other even though the heating wire of one module in the series is defective and inoperable. While this type of modular system permits various lengths to be installed, and permits extensions of the system after installation, the system disclosed in the patent does not readily lend itself to a simple installation of one section and does not contain features necessary for conveniently checking the integrity of the system. It is therefore one of the principal objects of the present invention to provide a heating cable system of the modular type which includes a first module having a cold lead ready for immediate installation and which can be extended to various lengths after installation to meet heating requirements of the structure being protected.

Another object of the invention is to provide a modular heating cable system in which all sections are flexible and only one cold lead or connection is made into the building supply circuit, and which can be extended and readily modified from time to time as required to obtain optimum performance of the system under varying conditions.

Still another object of the invention is to provide a versatile and rugged modular heating cable system in which the initial module has at one end a thermostat, preferably with a testing device and a cold lead adapted to be plugged directly into an electrical outlet, and which has at the other end a connector for connection with another module.

Heating cables of the foregoing type are often used to protect water supply and drain pipes which are located in remote, hard to reach places such as beneath mobile and modular homes. Some cables used in the past have had testing devices incorporated therein, such devices usually consisting of a pouch containing a thermostat, a manually operated switch and a light bulb. These elements are usually incorporated in the heating cable between the cold lead and the heating wire section. Another similar type has the bulb in a pouch which is remote from the thermostat and switch and which is connected to the cable at the thermostat and switch pouch. These types merely provide a shunt across the thermostat so that the heating cable will heat; however, the light merely indicates the availability of electrical power in the cold lead of the cable without indicting the integrity of the heating section. The heating section integrity is tested by feeling the heat with the hand. Still another type has the switch and bulb in a remote pouch. The present invention involves the use of a remote switch and light pouch which permits effective testing of the integrity of the heating section of the cable whether the thermostat is in operation or not, i.e. whether the ambient temperature is above or below the temperature at which the thermostat operates. It is thus another object of the invention to provide an electrical heating cable having a remote testing unit with a switch and bulb which will test both the availability of power to the cable and also the integrity of the heating section of the cable. A further object is to provide a system utilizing the remote testing device in combination with the aforementioned modular heating cable system.

Additional objects and advantages of the invention will become apparent from the following description and accompanying drawings, wherein.

Figure 1:
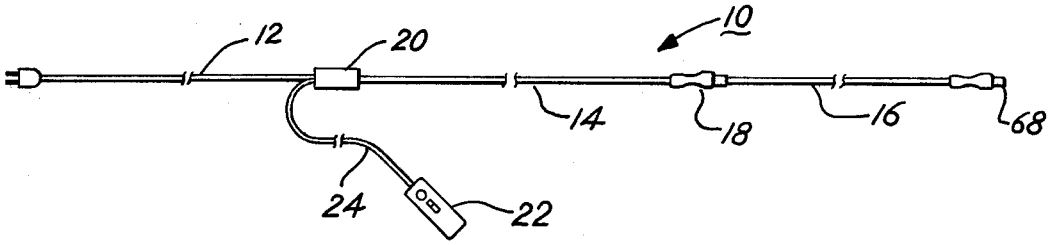
FIG. 1 is a plan view of a heating cable system embodying the present invention, showing the various components comprising the assembled system.

Referring more specifically to the drawings, and to FIG. 1 in particular, numeral 10 indicates generally the present heating cable system, consisting of the basic sections of the cold lead section 12, and heating sections 14 and 16 connected to one another by connector 18, the two sections 14 and 16 being modules of the system which may be of various lengths depending upon the requirements for particular installation. Numeral 20 designates a pouch having a thermostat therein for sensing the temperature of the structure heated by the heating cable and numeral 22 indicates a pouch containing a switch and light for testing the system, the latter pouch being connected to the wiring in pouch 20 by a line 24. Line 24 may be of various lengths to permit test pouch 22 to be placed at a convenient location, particularly when the heating cable is installed on a structure which is difficult to reach such as the water pipe of a mobile or modular home. The testing device of pouch 22 permits the testing of the system from a position remote from the heated structure.

Section 14 is connected directly and permanently to the cold lead wires 26 and 28 in pouch 22 and the cold leads are connected to the male plug 30 of conventional construction. In the preferred embodiment of the present invention, each heating section or module consists of two parallel cold wires 40 and 42 and an electrical resistance heating wire 44 connected at opposite ends to opposite ends of wires 40 and 42. Thus the current is available for module 16 and any other modules connected thereto even if the resistance wire in section 14 is defective. The two modules are connected by waterproof connector 18 consisting of a female socket 60 and a male plug 62, the plug and socket being connected to one another in the usual manner. When the two parts are connected, the prongs 64 and 66 are connected directly to wires 40 and 42, respectively. With this arrangement the module 16 can operate whether or not module 14 is in proper operating condition. The last socket of the module series is closed by a plug 68 which forms a water tight closure for the socket.

The system is tested and controlled by the circuitry of sealed pouches 20 and 22. A thermostat 70 is disposed in cold wire lead 26 and pouch 20 is adapted to be placed in close proximity to the structure being heated by the heating cable system. The cold lead 26 is connected through the thermostat to wire 42 and to resistance wire 44 by leads 72 and 74 connected to one another by a manually operated switch 76 in pouch 22. When the switch and thermostat are closed, the current flows from cold lead 26 through the thermostat 70, lead 72, switch 76 and lead 74 to resistance wire 44 and thence to leads 40 and 28, thus completing the heating circuit for the heating cable. The circuit thus described is controlled in normal operation by thermostat 70, which controls the current flowing through line 42, and consequently, if additional modules such as module 16 are attached to section 14, the thermostat likewise controls the operation of the modules in response to the ambient temperature around pouch 20.

Figure 3:
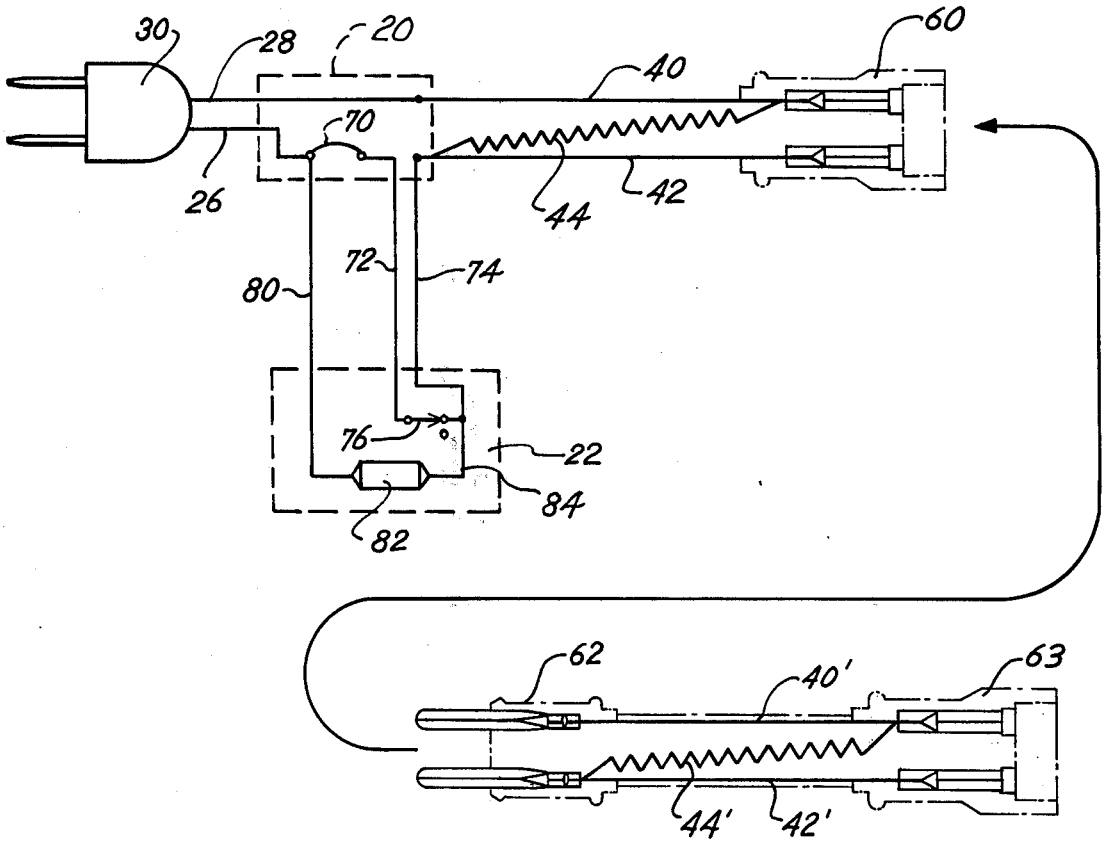
FIG. 3 is a schematic diagram of the present heating cable system illustrating the manner in which it is assembled and operated.
Figure 2:
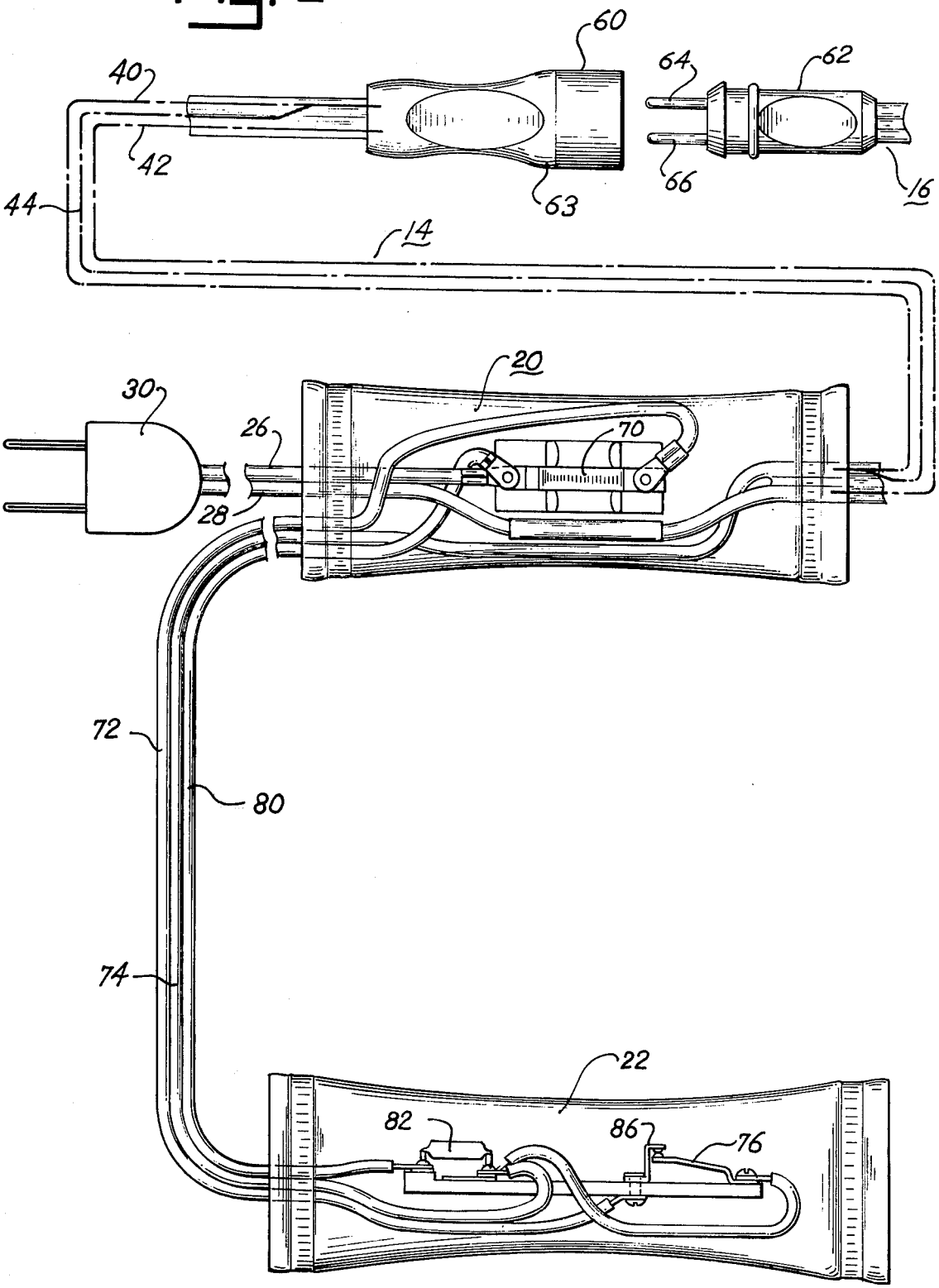
FIG. 2 is an enlarged plan view of the principal parts of the system shown in FIG. 1, illustrating the manner in which the cable system is assembled.

Module 16 and any additional module incorporated in the system are essentially the same as section 14, consisting of lines 40′ and 42′ and interconnecting resistance heating wire 44′. Each module has a male plug 62 and a female socket 63, the two wires 40′ and 42′ being parallel to one another and transmitting the electrical energy directly from the male plug 62 to socket 63, and the resistance heating wire 44′ is connected at opposite ends to opposite ends of wires 40′ and 42′ in the same manner as these corresponding elements are connected in section 14, this arrangement being best seen in FIG. 3.

The circuit for testing the system, including the integrity of at least one of the resistance heating wires in the series of modules, consists of a lead 80 connected to cold wire 26, a high resistance neon light 82, and a lead 84 connecting the neon light to lead 74. The neon light and switch 76 are enclosed in pouch 22 which is of a flexible transparent or translucent material and will yield sufficiently to permit manual operation of switch 76 to test the integrity of the heating system, including a resistance wire 44 or 44′ when thermostat 70 is in closed position. Switch 76 consists essentially of a leaf spring which is always biased to its closed position with contact 86. Thus the switch will remain closed unless manually pressed opened by someone pressing inwardly on the flexible side walls of pouch 22 with a thumb or finger. When the pressure is released the leaf spring switch 76 will again engage contact 86 and close the circuit between line 72 and line 74. Thus, when either the thermostat 70 or switch 76 is open while the plug 30 is connected to a source of electrical power, the current flows from cold lead 26 through lead 80 to the high resistance neon light 82 and thence through line 84 to lead 74, thus completing a circuit to wire 42 and resistance wire 44. The high resistance neon light carries only sufficient voltage to create an observable glow without transmitting any significant voltage from lead 80 to line 84 and lead 74. Thus the neon light will glow whenever the system is connected to a source of power while thermostat 70 is in its open position. When thermostat 70 closes, the neon light will not glow unless switch 76 is manually operated to interrupt the circuit between the thermostat and lead 74.

In the use and operation of the present heating cable system, sections 14 and 16 and any other modules which may be attached thereto are placed on the structure to be heated, preferably being helically wound around a water pipe, and plug 30 is connected to a source of electrical power. In this installation, the pouch 20 is placed against, or in close proximity to, the water pipe so that it senses the temperature thereof, the thermostat preferably being set to close at several degrees above freezing. After the installation has been made in the foregoing manner, if the temperature is above that at which thermostat 70 will close, neon light 82 glows, thus showing that the system is in effective operating condition. When the temperature drops so that the thermostat closes, the resistance wires 44 and 44′ become hot and the heat is transmitted through the insulation on the heating cable to the water pipe, thus providing sufficient heat to prevent freezing thereof. When the thermostat is closed the circuit is completed through leads 72 and 74 and switch 76, shunting the circuit for neon light 82 and rendering it inoperative.

When the installation is made, pouch 22 is placed in a convenient location such as the lower edge of the side wall of a mobile or modular home, thus permitting the system to be tested without having to contact the heating sections of the system. When the unit is in operation and the thermostat is closed, the system is tested by pressing inwardly on the flexible side walls of plastic pouch 22 to open switch 76, thereby causing the neon light to glow. When the pressure is released from the switch, it automatically closes, thereby reconnecting lines 72 and 74 and shunting the current around light 82 so that it will not glow. As mentioned previously, with an installation such as a mobile or modular home, if the thermostat is open the light will glow, thus indicating the system will be in operating condition if the temperature drops to a point where the thermostat will close.

While a number of variations have been mentioned herein, other changes and modifications can be made without departing from the scope of the invention.

I claim:

1. A flexible electric heating cable comprising a cold lead section having two cold wires, electrical means for connecting said cold wires to a source of electrical power, a heating section having a resistance heating wire and electrical insulation surrounding said heating wire, a thermostatic element connected to one of said cold wires, electrical means connecting the other of said cold wires to one end of said resistance wire, a light and manually operated, normally closed switch remotely located from said cold and heating sections, enclosure means containing said light and said enclosure means being at least partially flexible and partially translucent for operating said switch and observing said light switch, a first lead connecting at one end to said one cold lead between the source of power and said thermostatic element and at the other end to said light, a second lead connected to the other end of said resistance wire and to said light to complete a circuit through said light, a third lead connected to the side of said thermostatic element opposite said first lead and to said switch, and a means connecting said switch to said second lead, whereby said light glows when either said switch or thermostat is open while the cable is connected to a source of power if neither the cold nor heating sections is defective.

2. A flexible electric heating cable as defined in claim 1 in which two cold wires extend the length of the heating section and said resistance wire is connected at opposite ends to opposite ends of said latter cold wires.

3. A flexible electric heating cable as defined in claim 2 in which a socket is connected to the end of said heating section opposite said cold section for receiving a plug for a heating section module.

4. A flexible electric heating cable as defined in claim 1 in which said enclosure means consists of a flexible translucent pouch and said switch is manually operated by pressing said flexible pouch inwardly.

5. A flexible electrical heating cable as defined in claim 2 in which said enclosure means consists of a flexible translucent pouch and said switch is manually operated by pressing said flexible pouch inwardly.

6. A flexible electric heating cable as defined in claim 1 in which said light is a high resistance glow type through which insufficient current will pass to cause a glow when said switch and thermostatic element are closed.

7. A flexible electric heating cable as defined in claim 5 in which said light is a high resistance neon type through which insufficient current passes when said switch or thermostatic element is open to heat said resistance wire.

8. A flexible electric heating cable as defined in claim 1 in which said thermostatic element is enclosed in a pouch and is located in the area adjacent the junction between said cold lead section and said heating section.

9. A flexible electric heating cable as defined in claim 5 in which said thermostatic element is enclosed in a pouch and is located in the area adjacent the junction between said cold lead section and said heating section.

10. A flexible electric heating cable as defined in claim 3 in which said enclosure means consists of a flexible translucent pouch and said switch is manually operated by pressing said flexible pouch, and in which said thermostatic element is enclosed in a pouch and is located in the area adjacent the junction between said cold lead and said heating section.

* * * * *